US006308480B1

(12) United States Patent
Haney

(10) Patent No.: US 6,308,480 B1
(45) Date of Patent: Oct. 30, 2001

(54) CEILING TILE DUST GUARD

(76) Inventor: Joseph Michael Haney, 4430 Spring, Corpus Christi, TX (US) 78415

( * ) Notice: Subject to any disclaimer, the term of this patent is extended or adjusted under 35 U.S.C. 154(b) by 0 days.

(21) Appl. No.: 09/721,805

(22) Filed: Nov. 27, 2000

Related U.S. Application Data

(63) Continuation of application No. 09/351,366, filed on Jul. 12, 1999, now abandoned.

(51) Int. Cl.[7] ..... E04B 1/70

(52) U.S. Cl. ..... 52/302.6; 52/219; 52/211; 52/58; 52/220.8; 52/94

(58) Field of Search ..... 52/287.1, 219, 52/211, 302.6, 288.1, 58, 220.8, 506.01, 506.02, 506.06, 506.07, 94, 95, 96

(56) References Cited

U.S. PATENT DOCUMENTS 5,687,514 * 11/1997 Gillispie ..... 52/58

* cited by examiner

*Primary Examiner*—Beth A. Stephan
*Assistant Examiner*—Dennis L. Dorsey

(57) ABSTRACT

A ceiling tile dust guard is provided wherein the dust guard includes in combination a room having wall and the wall comprising a ceilimg, a ventilation duct vent, and rails in the ceiling. The duct vent defines a plane parallel to the ceiling and provides a direction of air flow out of the vent into the room; the dust guard adjacent the duct vent provides a peripheral wall substantially perpendicular to and projecting away from the duct vent into the room diverting air flowing through the vent away from the ceiling adjacent the vent so that static electricity doesn't attract particles in the air flow onto the ceiling. The duct vent comprises a vent housing and the supporting means comprises rails in the ceiling supporting the vent housing. The dust guard comprises a first element captivated between the vent housing and the rails, the peripheral wall being supported by the first element wherein the first element comprising a panel perpendicular to the peripheral wall and wherein the dust guard held in place by the weight of the vent housing.

17 Claims, 2 Drawing Sheets

CEILING TILE DUST GUARD

This application is a continuation of application Ser. No. 09/351,366, filed Jul. 12, 1999; ABN.

BACKGROUND OF THE INVENTION

1. Field of the Invention

This invention relates in general to the maintenance of ceiling tiles and in particular to the preventive maintenance of ceiling tiles adjacent a ventilation duct vent by the use of a dust guard for directing air flow out of the vent into a room so that static electricity doesn't attract particles in the air flow onto the ceiling adjacent the ventilation duct vent.

2. Description of Related Art

Buildings that have a suspended ceiling generally have a prevailing maintenance problem in keeping the ceiling tiles clean especially in areas adjacent the ventilation duct vents. The problem exists because duct vents generally direct air into a room in a manner that allows static electricity to attract particles in the air flow onto the ceiling adjacent the vents resulting in dust particle residue and staining to build up on the ceiling. Ceiling cleaning procedures generally require the use of chemicals and is expensive.

The periodic changing of air filters is also a temporary solution since as soon as filters become loaded with dust the maintenance problem resumes and particles in the air flow out of the duct vent quickly attract onto the ceiling adjacent the duct vents.

I have discovered a way to maintain ceiling tiles clean in particular the ceiling tiles adjacent a ventilation duct vent by the use of a dust guard device. The dust guard device works by providing a peripheral wall substantially perpendicular to and projecting away from the duct vent into a room for directing air into the room so that static electricity doesn't attract particles in the air flow onto the ceiling tiles adjacent the duct vent.

SUMMARY OF THE INVENTION

The present invention is directed to a dust guard for installation on a room ventilation duct vent. The duct vent defining a plane parallel to the ceiling and providing a direction of air flow out of the vent into the room. The dust guard adjacent the duct vent providing a peripheral wall substantially perpendicular to and projecting away from the duct vent into the room directing air into the room so that static electricity doesn't attract particles in the air flow onto the ceiling tiles adjacent the duct vent. The dust guard comprising in combination, a room having a wall with the wall comprising a ceiling, a ventilation duct vent, and rails in the ceiling;

In combination, the duct vent comprising first and second parallel rails in the ceiling and third and fourth parallel rails in the ceiling perpendicular to the first and second rails; the first, second, third, and fourth rails supporting the vent housing; and the dust guard being captivated between, the vent housing and the first, second, third, and fourth rails wherein the dust guard is held in place by the weight of the vent housing.

The dust guard further comprising in combination, a first element captivated between the vent housing and the rails in the ceiling, the peripheral wall being supported by the first element and the first element comprising a panel perpendicular to the peripheral wall. The duct vent having first and second parallel sides and third and fourth parallel sides perpendicular to the first and second sides, and the dust guard further comprising a first member having a first section lying along the first side of the duct vent and a second section attached to and perpendicular to the first section lying along the third side of the duct vent and a second member having a third section lying along the second side of the duct vent and a fourth section attached to and perpendicular to the third section lying along the fourth side of the duct vent.

DETAILED DESCRIPTION

Figure 1:
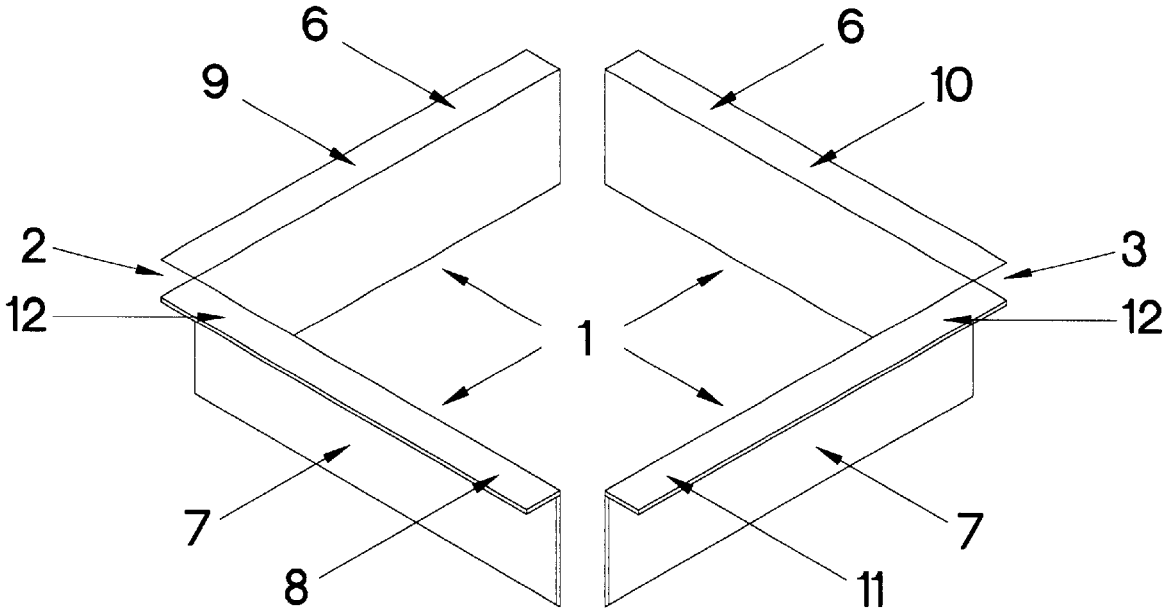
FIG. 1 is a perspective view of the invention showing the ceiling tile dust guard properly placed to form the preferred embodiment of the invention.
Figure 2:
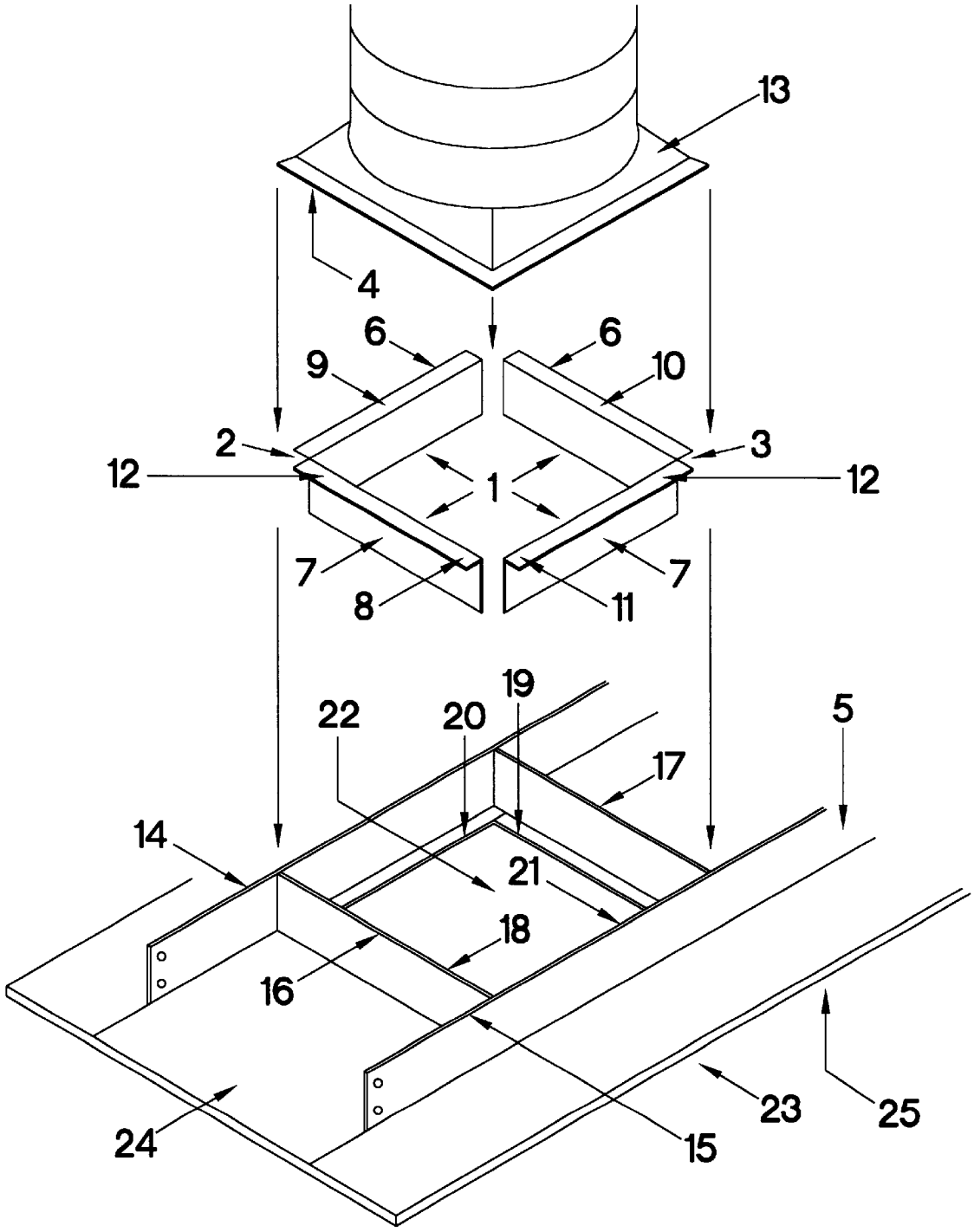
FIG. 2 is a perspective view showing in combination the ventilation duct vent, a dust guard, rails in the ceiling and the ceiling.

A ceiling tile dust guard is shown in FIG. 1 and FIG. 2 and indicated by reference number 1. The ceiling tile dust guard 1 comprises in combination a room having a wall and the wall comprising a ceiling 23, a ventilation duct vent 4, and the rails 5 in the ceiling 23.

The duct vent 4 defining a plane parallel to the ceiling 23 and providing a direction of air flow out of the vent 4 into said room; the dust guard 1 adjacent the duct vent 4 providing a peripheral wall 7 substantially perpendicular to and projecting away from the duct vent 4 into the room directing air into the room so that static electricity doesn't attract particles in the air flow onto the ceiling 23 adjacent the duct vent 4. The ventilation duct vent 4 comprising a vent housing 13 and the duct vent 4 in combination further comprising first 14 and second 15 parallel rails in the ceiling 23 and third 16 and fourth 17 parallel rails in the ceiling 23 perpendicular to the first 14 and second 15 rails, The dust guard 1 further comprising a first element 6 captivated between the vent housing 13 and the rails 5 in the ceiling 23 whereby the peripheral wall 7 being supported by the first element 6, the first element 6 comprising a panel 12 perpendicular to the peripheral wall 7 and wherein the dust guard 1 is held in place by the weight of the vent housing 13. The duct vent 4 in combination, further comprises a wall covering 25 adjacent the duct vent 4 and the dust guard 1 directs air from the wall covering 25, the ventilation duct vent 4 in combination further comprises a frame 22 having an opening therein allowing air to flow into a room and a housing 13 supported on the frame 22; and a dust guard 1 captivated between the frame 22 and the housing 13 for diverting air flowing through the vent 4 away from a wall adjacent the vent 4. The dust guard 1 in combination, further comprises a first element 6 captivated between the vent 4 and the frame 22, and a wall peripheral 7 extending into the room generally parallel to the direction of air flow, in combination, the dust guard 1 further comprises a peripheral wall 7 extending around the opening.

I claim:

1. In combination, a room having a wall, a ventilation duct vent defining a plane parallel to the wall and providing a direction of air flow out of the vent into the room; and a dust guard adjacent the duct vent providing a peripheral wall substantially perpendicular to and projecting away from the duct vent into the room for directing air into the room so that static electricity doesn't attract particles in the air flow onto the wall adjacent the vent.

2. The combination of claim 1 wherein the wall comprises a ceiling and the duct vent comprises a vent housing and further comprising first and second parallel rails in the ceiling supporting the vent housing, the dust guard comprising a first element captivated between the vent housing and the rails, the peripheral wall being supported by the first element.

3. The combination of claim 2 wherein the first element comprises a panel perpendicular to the wall.

4. The combination of claim 2 wherein the dust guard is held in place by the weight of the vent housing.

5. The combination of claim 2 wherein the duct vent has first and second parallel sides and third and fourth parallel sides perpendicular to the first and second sides, and the dust guard comprises a first member having a first section lying along the first side of the duct vent and a second section attached to and perpendicular to the first section lying along the third side of the duct vent, and a second member having a third section lying along the second side of the duct vent and a fourth section attached to and perpendicular to the third section lying along the fourth side of the duct vent.

6. The combination of claim 5 further comprising third and fourth parallel rails in the ceiling perpendicular to the first and second rails, the first, second, third and fourth rails supporting the vent housing, the dust guard being captivated between the vent housing and the first, second, third and fourth rails.

7. The combination of claim 2 further comprising a ceiling tile on the ceiling adjacent the duct vent and the dust guard directs air away from the ceiling tile.

8. In combination, a ventilation duct vent comprising means supporting the duct vent and providing an opening allowing air flow along a path out of the vent into a room; and a dust guard adjacent the duct vent providing a peripheral wall substantially perpendicular to and projecting away from the duct vent into the room.

9. The combination of claim 8 wherein the duct vent comprises a vent housing and the supporting means comprises first and second parallel rails supporting the vent housing, the dust guard comprising a first element captivated between the vent housing and the rails, the peripheral wall being supported by the first element.

10. The combination of claim 9 wherein the first element comprises a panel perpendicular to the peripheral wall.

11. The combination of claim 9 wherein the dust guard is held in place by the weight of the vent housing.

12. The combination of claim 9 wherein the duct vent has first and second parallel sides and third and fourth parallel sides perpendicular to the first and second sides, and the dust guard comprises a first member having a first section lying along the first side of the duct vent and a second section attached to and perpendicular to the first section lying along the third side of the duct vent, and a second member having a third section lying along the second side of the duct vent and a fourth section attached to and perpendicular to the third section lying along the fourth side of the duct vent.

13. The combination of claim 12 further comprising third and fourth parallel rails perpendicular to the first and second rails, the first, second, third and fourth rails supporting the vent housing, the dust guard being captivated between the vent housing and the first, second, third and fourth rails.

14. The combination of claim 9 further comprising a wall covering adjacent the duct vent and the dust guard directs air away from the wall covering.

15. In combination, a ventilation duct installation comprising a frame having an opening therein allowing air to flow into a room and a housing supported on the frame; and a dust guard captivated between the frame and the housing for diverting air flowing through the opening away from a wall adjacent the opening.

16. The combination of claim 15 wherein the dust guard comprises a first element between the vent and the frame, and a wall extending into the room generally parallel to the direction of air flow.

17. The combination of claim 16 wherein the wall comprises a peripheral wall extending around the opening.

* * * * *